US008529293B2

(12) United States Patent
Ootani et al.

(10) Patent No.: US 8,529,293 B2
(45) Date of Patent: Sep. 10, 2013

(54) COAXIAL CONNECTOR

(75) Inventors: Hideyuki Ootani, Tokyo (JP); Yosuke Saito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 195 days.

(21) Appl. No.: 13/117,855

(22) Filed: May 27, 2011

(65) Prior Publication Data

US 2012/0108103 A1 May 3, 2012

(30) Foreign Application Priority Data

Nov. 1, 2010 (JP) ..... 2010-245047

(51) Int. Cl.
*H01R 9/05* (2006.01)

(52) U.S. Cl.
USPC ..... 439/578

(58) Field of Classification Search
USPC ..... 439/63, 578–581
See application file for complete search history.

(56) References Cited

U.S. PATENT DOCUMENTS

| | | | | |
|---|---|---|---|---|
| 6,074,217 | A * | 6/2000 | Maruyama et al. | 439/63 |
| 7,367,811 | B2 * | 5/2008 | Nagata | 439/63 |
| 7,758,377 | B2 * | 7/2010 | Maruyama | 439/582 |
| 7,985,076 | B2 * | 7/2011 | Zuinen et al. | 439/63 |
| 2004/0137764 | A1 | 7/2004 | Yamane | |
| 2005/0159022 | A1 * | 7/2005 | Nagata | 439/63 |
| 2010/0081308 | A1 * | 4/2010 | Wang et al. | 439/248 |
| 2010/0214192 | A1 | 8/2010 | Chao | |
| 2011/0053411 | A1 * | 3/2011 | Zuinen et al. | 439/578 |

FOREIGN PATENT DOCUMENTS

| | | |
|---|---|---|
| JP | 06-5158 | 1/1994 |
| JP | 8-321361 | 3/1996 |
| JP | 2001-35598 A | 2/2001 |
| JP | 2004-031187 | 1/2004 |
| JP | 2010-108719 | 5/2010 |

OTHER PUBLICATIONS

Machine translation of JP2010-108719 published on May 13, 2010.
Office Action dated Nov. 30, 2011 for corresponding Finnish application No. 20115551 and English translation thereof.
Partial translation of the Office Action issued on Jul. 3, 2012 in counterpart Japanese Application No. 2010-245047.
Abstract and JPO Website computer-generated English translation of JP 2001-35598A.

* cited by examiner

*Primary Examiner* — Truc Nguyen
(74) *Attorney, Agent, or Firm* — Hovey Williams LLP

(57) ABSTRACT

A coaxial connector comprises a receptacle having an engagement hole formed inside and a plug engaging with the receptacle along an engagement axis, wherein the receptacle includes an annular receptacle external contact of which an inner peripheral surface is exposed inside the engagement hole, and a receptacle central contact having a receptacle central contact portion exposed in a direction perpendicular to the engagement axis inside the engagement hole, wherein the plug includes a plug external contact engaging with the inside of the engagement hole of the receptacle so as to be in contact with the inner peripheral surface of the annular receptacle external contact, and a cantilever-shaped plug central contact having an extension extending in a direction perpendicular to the engagement axis and a plug central contact portion positioned so as to be in contact with the receptacle central contact portion inside the engagement hole.

7 Claims, 6 Drawing Sheets

COAXIAL CONNECTOR

BACKGROUND OF THE INVENTION

The present invention relates to a coaxial connector and particularly to reduction in height of a coaxial connector.

So-called angle-type coaxial connectors for connecting coaxial cables at a given angle to terminals mounted on a circuit board have been widely used in communication devices and the like. Use of such coaxial connectors enables height reduction with the electronic devices incorporating circuit boards.

A coaxial connector of this kind comprises a receptacle and a plug that engage with each other. Typically, the receptacle comprises a central contact projecting like a pin in engagement direction while the plug comprises a central contact including a two-leaf spring portion, and the spring portion of the central contact of the plug pinches the pin-like central contact of the receptacle to achieve electric connection.

However, this kind of contact structure involving the central contact required a length of spring longer than a given length along the engagement direction to be secured for the spring portion in order to provide the leaf spring portion of the central contact of the plug with spring characteristics sufficient to achieve a high-reliability connection with the receptacle. Accordingly, reducing the height of the coaxial connector in engagement direction was impossible.

Thus, JP 6-5158 U, for example, describes a coaxial connector where, as illustrated in FIG. 10, a receptacle 1 comprises a flat receptacle central contact 2 perpendicular to the engagement direction, and a plug central contact 4 of a plug 3 in the form of a spring is brought into contact with the receptacle central contact 2.

SUMMARY OF THE INVENTION

However, because the plug central contact 4 is so shaped as to be routed from a contact portion with the flat receptacle central contact 2 in the engagement direction, reducing the height of the coaxial connector in engagement direction is difficult.

In addition, because the coaxial connector described in JP 6-5158 U has a plug external contact 5 that engages with and comes into contact with the outer periphery of a receptacle external contact 6, and because an engagement length longer than a given length is required to secure the engagement of the plug external contact 5 and the receptacle external contact 6 without allowing displacement, the height of the coaxial connector necessarily increases.

Further, because the receptacle external contact 6 is exposed at the outer periphery of the receptacle 1 during disengagement, not only are foreign matters allowed to attach to that periphery, but external forces may be directly applied to the receptacle external contact 6, making the coaxial connector unreliable.

An objective of the present invention is to overcome the above problems associated with the prior art and provide a coaxial connector enabling height reduction and increased reliability.

A coaxial connector according to the present invention comprises:

a receptacle having an engagement hole formed inside; and a plug engaging with the receptacle along an engagement axis, wherein the receptacle includes an annular receptacle external contact of which an inner peripheral surface is exposed inside the engagement hole, and a receptacle central contact having a receptacle central contact portion exposed in a direction perpendicular to the engagement axis inside the engagement hole, wherein the plug includes a plug external contact engaging with the inside of the engagement hole of the receptacle so as to be in contact with the inner peripheral surface of the annular receptacle external contact when the plug engages with the receptacle, and a cantilever-shaped plug central contact having an extension extending in a direction perpendicular to the engagement axis and a plug central contact portion positioned so as to be in contact with the receptacle central contact portion inside the engagement hole when the plug engages with the receptacle.

DETAILED DESCRIPTION OF THE INVENTION

Embodiments of the present invention will be described below based on the appended drawings.

Embodiment 1

Figure 1:
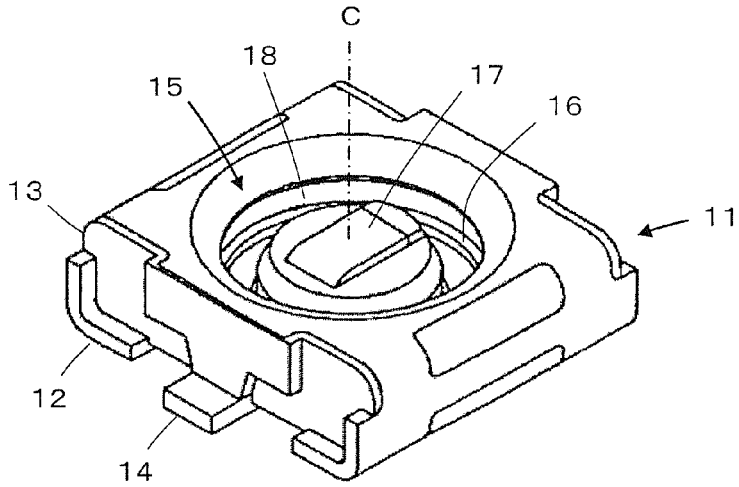
FIG. 1 is a perspective view of a receptacle used in a coaxial connector according to an embodiment 1 of the invention.
Figure 2A:
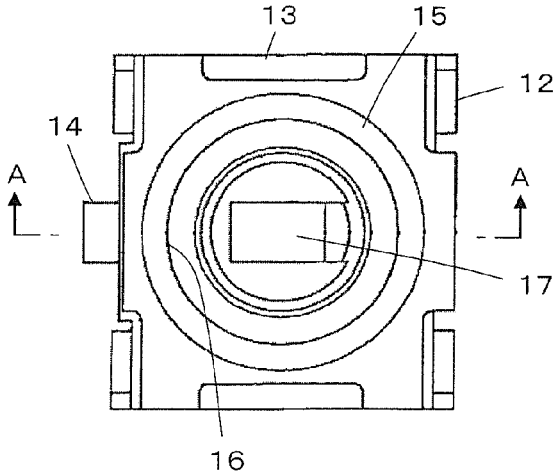
FIGS. 2A, 2B, and 2C are a top plan view, a side view, and a front view respectively illustrating a receptacle used in the coaxial connector according to the embodiment 1.
Figure 2B:
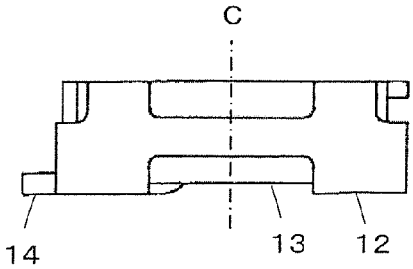
Figure 2C:
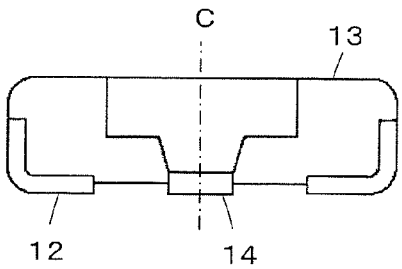

FIGS. 1 and 2 illustrate a receptacle 11 used in a coaxial connector according to an embodiment 1 of the invention. The receptacle 11 comprises a receptacle external contact 12, a receptacle insulator 13 and a receptacle central contact 14.

The receptacle external contact 12 has a an engagement hole 15 having a substantially annular shape as a whole for engagement with a plug described later, which engagement hole 15 exposes therein an inner peripheral surface 16 of the receptacle external contact 12. The central axis of the engagement hole 15 coincides with an engagement axis C for the receptacle 11 and the plug. Both lateral sides of the receptacle external contact 12 are folded toward the bottom side of the receptacle 11 so as to hold the integrally provided receptacle insulator 13.

The receptacle central contact 14 is a strip that is bent into the shape of a step, with one end portion protruding frontward from the receptacle 11 at the bottom thereof. The other end of the receptacle central contact 14 leads to a vicinity of the surface of the receptacle 11 in the engagement hole 15 and is exposed as a receptacle central contact portion 17 lying in a plane and in a direction perpendicular to the central axis of the engagement hole 15 or the engagement axis C for the receptacle 11 and the plug.

Figure 3:
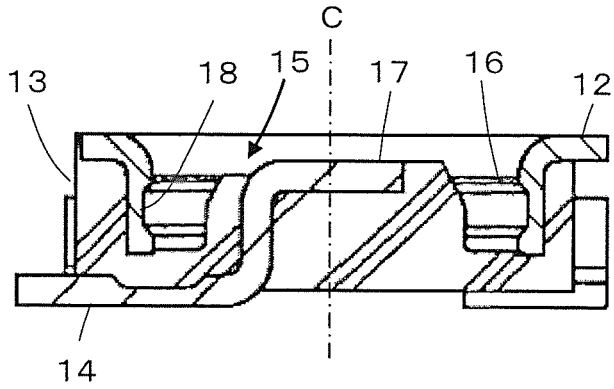
FIG. 3 is a cross section taken along line A-A of FIG. 2A.

As illustrated in FIG. 3, the receptacle insulator 13 covers the outer periphery of the annular receptacle external contact 12 and projects into the engagement hole 15 from the bottom side of the receptacle 11 without touching the inner peripheral surface 16 of the receptacle external contact 12. The receptacle insulator 13 thus holds the receptacle central contact 14.

There is formed in the inner peripheral surface 16 of the receptacle external contact 12 an annular receptacle external contact portion 18. The receptacle external contact portion 18 is a recess formed in the inner peripheral surface 16 of the receptacle external contact 12, so that the external contact of the plug fitted to the inside of the engagement hole 15 comes into contact therewith for engagement.

Figure 4:
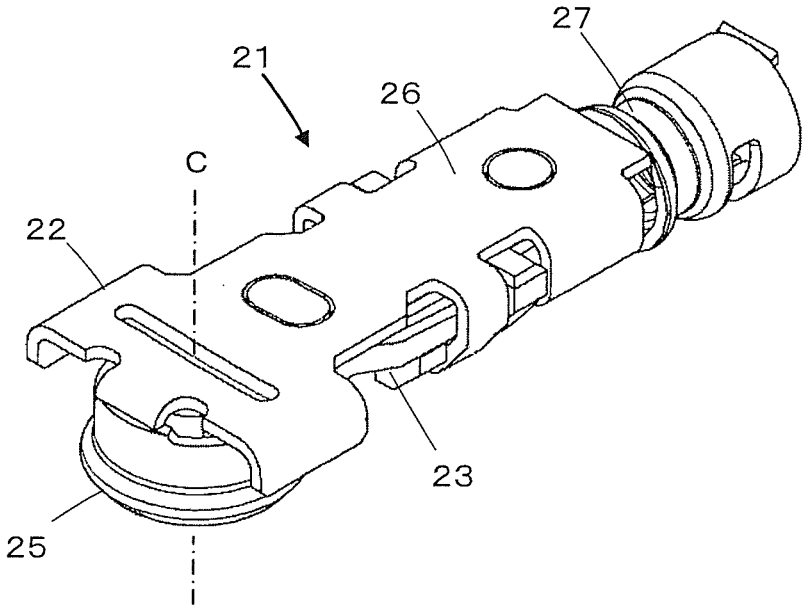
FIG. 4 is a perspective view of a plug used in the coaxial connector according to the embodiment 1.

FIGS. 4 and 5 illustrate a plug 21 used in the coaxial connector according to the embodiment 1. The plug 21 comprises a plug external contact 22, a plug insulator 23 and a plug central contact 24.

The plug external contact 22 comprises an arc-shaped plug external contact portion 25 having its center at the engagement axis C for engagement with the receptacle 11. The plug external contact portion 25 comes into contact with the annular receptacle external contact portion 18 in the engagement hole 15 of the receptacle 11 as the plug 21 is fitted into the receptacle 11 and has a shape in cross section outwardly projecting so as to engage with the recessed receptacle external contact portion 18.

The plug external contact 22 comprises an extension 26 extending from the engagement axis C for engagement with the receptacle 11 in a direction perpendicular to the engagement axis C. The extension 26 comprises a cable connecting portion 27 near its other end, to which an external conductor of a coaxial cable is connected.

Figure 5A:
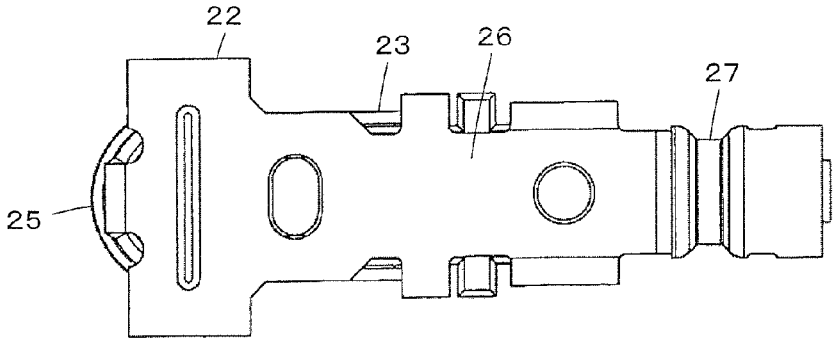
FIGS. 5A, 5B, 5C, and 5D are a top plan view, a side view, a bottom view, and a front view respectively illustrating a plug used in the coaxial connector according to the embodiment 1.
Figure 5B:
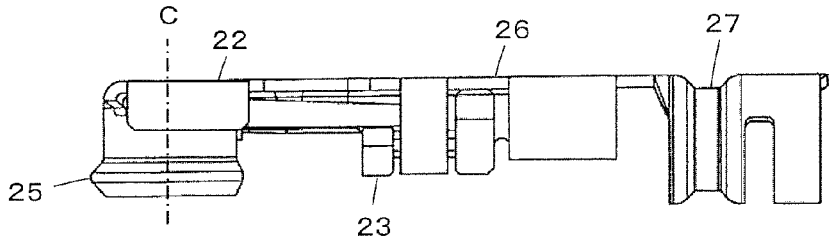
Figure 5C:
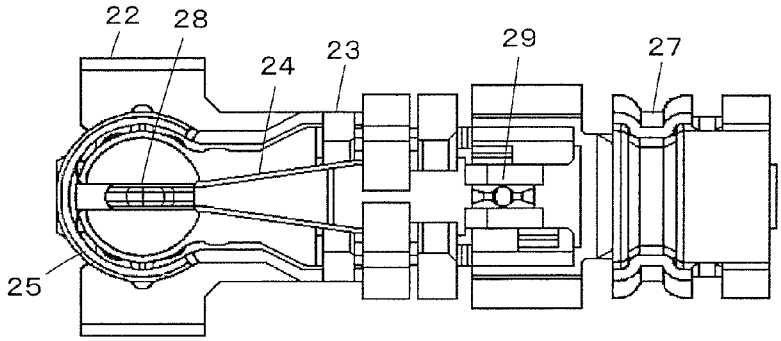
Figure 5D:
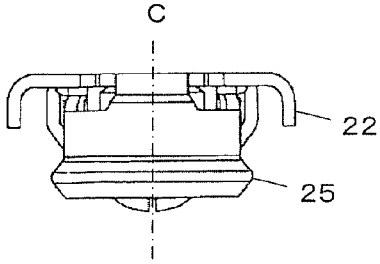

As illustrated in FIG. 5C, the plug central contact 24 is secured through the plug insulator 23 to the plug external contact 22 near the middle portion of the extension 26 of the plug external contact 22 and extends therefrom to a vicinity of the engagement axis C for engagement with the receptacle 11 substantially parallel to the extension 26 of the plug external contact 22, so that the plug central contact 24 is shaped like a cantilever. The plug central contact 24 comprises a plug central contact portion 28 at the free end of the cantilever positioned close to the engagement axis C for engagement with the receptacle 11. The plug central contact portion 28 comes into contact with the receptacle central contact portion 17 as the plug 21 engages with the receptacle 11 to achieve electric connection.

Because the plug central contact 24 is thus shaped like a cantilever extending substantially in parallel to the extension 26 of the plug external contact 22, a sufficient length of spring can be secured to provide the plug central contact 24 with spring characteristics sufficient to establish a highly reliable connection between the plug central contact portion 28 and the receptacle central contact portion 17 as the plug 21 and the receptacle 11 engage.

As illustrated in FIG. 5C, the plug external contact portion 25 is shaped into an arc having a segment removed in a direction in which the plug central contact 24 extends. Thus, the plug central contact portion 28 is located inside the arc-shaped plug external contact portion 25, whereas the plug central contact 24 extends through a portion where the plug external contact portion 25 does not exist.

The plug central contact 24 further has a cable connecting portion 29 formed near a portion at which the plug external contact 24 is secured to the plug external contact 22 for connection to a central conductor of an axial cable.

The plug insulator 23 secures the plug central contact 24 to the plug external contact 22 in the middle portion of the extension 26 of the plug external contact 22 and is provided on the bottom surface of the extension 26 to prevent short-circuiting between the plug external contact 22 and the plug central contact 24.

Next, the operations of the coaxial connector according to the embodiment 1 will be described.

Figure 6:
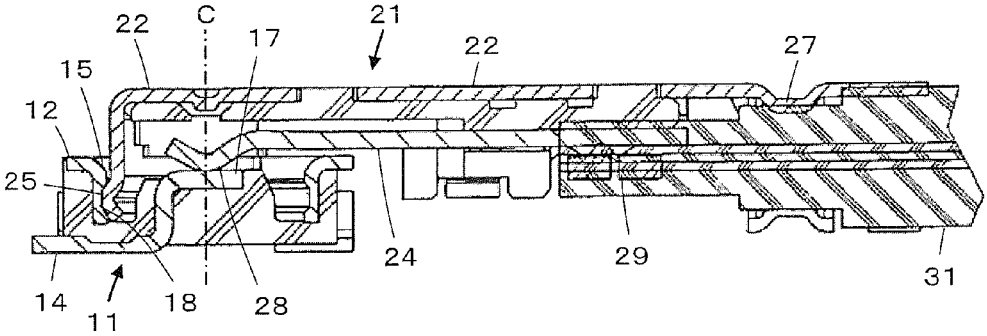
FIG. 6 is a cross section of a structure of the coaxial connector according to the embodiment 1.

As illustrated in FIG. 6, it is supposed that the plug external contact 22 of the plug 21 has been previously connected with the external conductor of an axial cable 31 while a cable connecting portion 29 of the plug central contact 24 has been previously connected with the central conductor of the axial cable 31. It is also supposed that the receptacle 11 is mounted on a circuit board of an electric device, not shown.

When the plug external contact portion 25 of the plug external contact 22 of the plug 21 is pushed into the engagement hole 15 of the receptacle along the engagement axis C for engagement, the outwardly projecting arc-shaped plug external contact portion 25 comes into contact with the recessed receptacle external contact portion 18 to establish electric connection between the plug external contact portion 25 and the receptacle external contact portion 18 while the plug external contact portion 25 engages with the recessed receptacle external contact portion 18.

Upon the plug external contact portion 25 engaging with the receptacle external contact portion 18, the plug central contact portion 28 of the plug central contact 24 comes into contact with the receptacle central contact portion 17 exposed and lying in a plane and in a direction perpendicular to the engagement axis C inside the engagement hole 15 of the receptacle 11. Now, the cantilever-like plug central contact 24 possesses given spring characteristics secured by the sufficient length of spring, so that a highly reliable connection can be established between the plug central contact portion 28 and the receptacle central contact portion 17.

Thus, the external conductor of the axial cable 31 is electrically connected to the receptacle external contact 12 through the plug external contact 22, the plug external contact portion 25, and the receptacle external contact portion 18 sequentially, and the central conductor of the axial cable 31 is electrically connected to the receptacle central contact 14 to the plug central contact 24, the plug central contact portion 28, and the receptacle central contact portion 17 sequentially.

Because the plug central contact 24 is shaped like a cantilever extending perpendicularly to the engagement axis C, a sufficient length of spring can be secured regardless of the height in the direction along the engagement axis C while the receptacle central contact portion 17 is so exposed as to lie in a plane and in a direction perpendicular to the engagement axis C, reduction in height of the axial coaxial connector can be attained while establishing a highly reliable connection at the same time.

When, in particular, the receptacle 11 and the plug 21 are engaged, the plug central contact 24 has a substantially flat shape extending in a direction perpendicular to the engagement axis C as illustrated in FIG. 6, while the contact plane in which the plug central contact portion 28 formed at the end of the plug central contact 24 is in contact with the receptacle central contact portion 17 lies so close in height to the extension of the plug central contact 24 that, it may be said, the contact plane lies substantially in the same plane as the extension of the plug central contact 24. Such a configuration serves to further help reduce the height of the coaxial connector.

Further, the configuration where the receptacle external contact portion 18 is formed in the inner peripheral surface of the engagement hole 15 and the receptacle central contact portion 17 is positioned inside the engagement hole 15 greatly reduces the chance of foreign matters, etc. attaching to the receptacle external contact portion 18 and the receptacle central contact portion 17 and, hence, the chance of unforeseen external forces being applied thereto, thus increasing the reliability in the coaxial connector.

Further, the receptacle insulator 13 covering the outer periphery of the annular receptacle external contact 12 minimizes the positional shift of the receptacle external contact 12 and thereby eliminates the chance of the engagement becoming loose and unstable even when the engagement length is short or when engagement and disengagement are repeated a number of times, thus enabling production of a highly reliable coaxial connector.

The receptacle 11 may be produced by integrally molding the receptacle external contact 12, the receptacle insulator 13, and the receptacle central contact 14 using injection molding method or the like. Thus, the receptacle external contact 12, the receptacle central contact 14 and the receptacle insulator 13 can be placed in a still closer contact with each other, and the strength of the receptacle 11 as a whole can be increased.

Similarly, the plug 21 may be produced by integrally molding the plug external contact 22, the plug insulator 23, and the plug central contact 24 using injection molding method or the like. Thus, the plug external contact 22, the plug central contact 24 and the plug insulator 23 can be placed in a still closer contact with each other, and the strength of the plug 21 as a whole can be increased.

Figure 7:
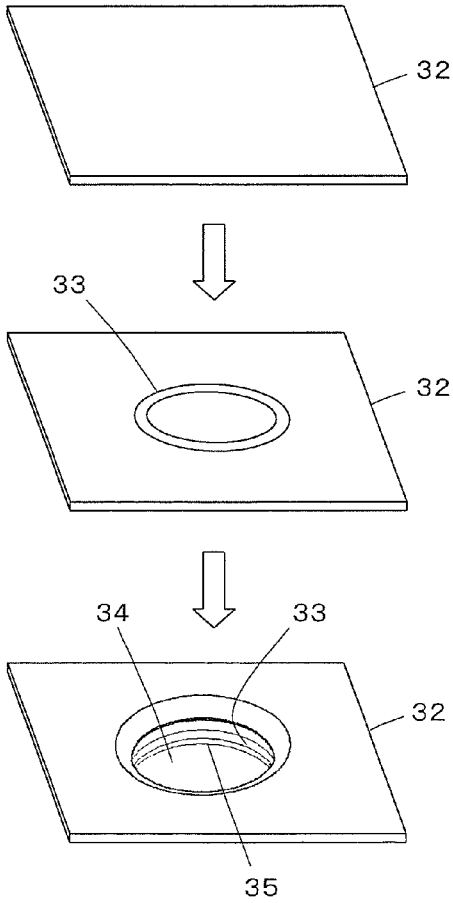
FIG. 7 illustrates steps following which a receptacle external contact portion is produced according to the embodiment 1.

The receptacle external contact portion 18 of the receptacle external contact 12 may be formed by bending but may be more readily formed by pressing a sheet. For example, an annular recess 33 as illustrated in FIG. 7 is formed in a metal sheet 32, a material for forming the receptacle external contact 12, by pressing the metal sheet, followed by burring to make an opening 34 at the center of the annular recess 33 and a rise 35 around the opening 34. The rise 35 is formed so that the annular recess 33 is positioned in the inner periphery. The recess 33 of the rise 35 thus formed is the receptacle external contact portion 18 while the opening 34 is the engagement hole 15.

Embodiment 2

Figure 8:
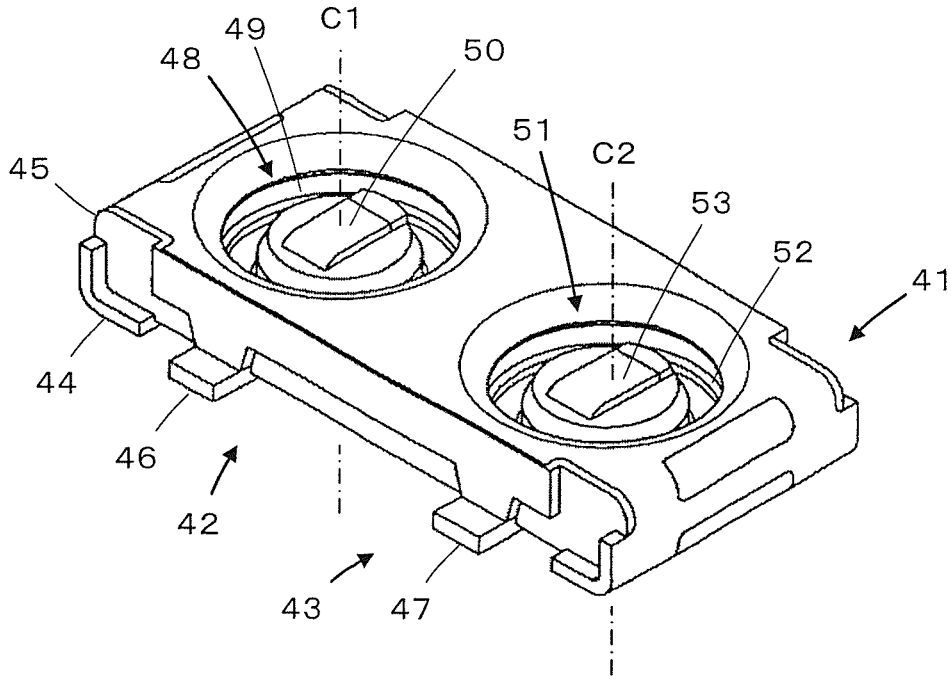
FIG. 8 is a perspective view of a receptacle member used in a coaxial connector according to an embodiment 2.
Figure 10:
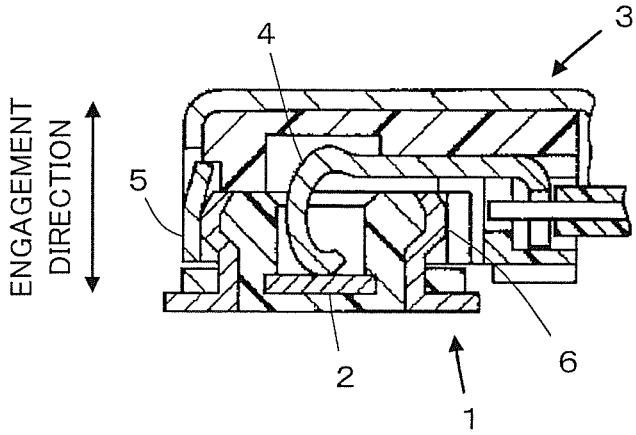
FIG. 10 is a cross section of a structure of a conventional coaxial connector.
Figure 9A:
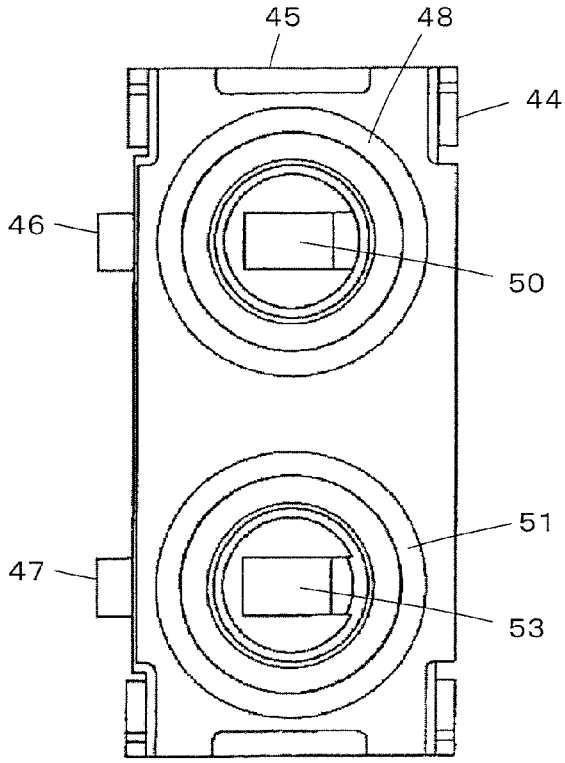
FIGS. 9A, 9B, and 9C are a top plan view, a side view, and a front view respectively illustrating a receptacle member used in the coaxial connector according to the embodiment 2.
Figure 9B:
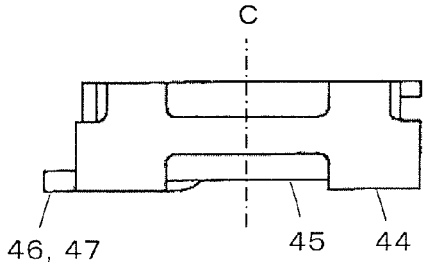
Figure 9C:
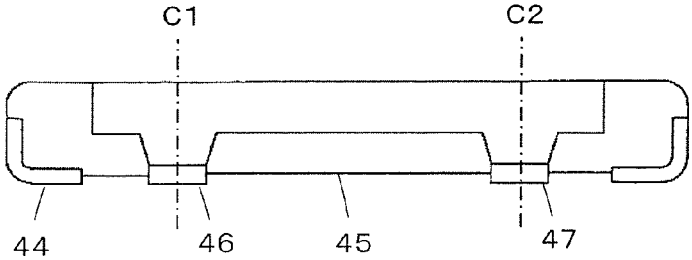

FIGS. 8 and 9 illustrate a receptacle member 41 used in a coaxial connector according to an embodiment 2. The receptacle member 41 is produced by integrally forming a first receptacle 42, which has the same configuration as the receptacle 11 according to the embodiment 1 illustrated in FIGS. 1 and 2, and a second receptacle 43, one close to the other.

The receptacle member 41 comprises a receptacle external contact 44, a receptacle insulator 45 and two receptacle central contacts 46 and 47.

The first receptacle 42 comprises a receptacle external contact 44, a receptacle insulator 45, and a receptacle central contact 46; the second receptacle 43 comprises a receptacle external contact 44, a receptacle insulator 45, and a receptacle central contact 47. The receptacle 43 comprises a receptacle external contact 44 and a receptacle central contact 47 integrally formed with the receptacle external contact 12 through a receptacle insulator 45.

The first receptacle 42 and the second receptacle 43 have the same inner structure as the receptacle 11 according to the embodiment 1 except that the receptacles 42, 43 share the receptacle external contact 44 and the receptacle insulator 45.

The first receptacle 42 comprises an engagement hole 48, an annular receptacle external contact portion 49 formed in the inner peripheral surface of an engagement hole 48, and a receptacle central contact portion 50 exposed in a plane and in a direction perpendicular to an engagement axis C1 inside the engagement hole 48.

Likewise, the second receptacle 43 comprises an engagement hole 51, an annular receptacle external contact portion 52 formed in the inner peripheral surface of the engagement hole 51, and a receptacle central contact portion 53 exposed in a plane and in a direction perpendicular to an engagement axis C2 inside the engagement hole 51.

The receptacle member 41 may be produced by integrally molding the receptacle external contact 44, the receptacle insulator 45, and the two receptacle central contacts 46, 47 using injection molding method or the like. Thus, the receptacle central contact 44, the receptacle central contacts 46, 47, and the receptacle insulator 45 can be placed in a still closer contact with each other, and the strength of the receptacle 41 as a whole can be increased.

The first receptacle 42 and the second receptacles 43 are each fitted with the plug 21 as illustrated in FIGS. 4 and 5. Specifically, the plug 21 engages with the first receptacle 42 along the engagement axis C1 while the plug 21 engages with the second receptacle 43 along the engagement axis C2.

This completes a two-core coaxial connector.

The outer periphery of the annular receptacle external contact portion 49 in the first receptacle 42, while the outer periphery of the annular receptacle external contact portion 52 in the second receptacle 43 are each covered by the receptacle insulator 45, and the plug 21 engages with the engagement hole 48 of the first receptacle 42 and the engagement hole 51 of the second receptacle 43, which enhances the freedom with which the first receptacle 42 and the second receptacle 43 are positioned and permits free designing according to the use.

A three-core or multi-core coaxial connector may be produced in like manner.

The present invention enables production of a coaxial connector as illustrated in FIG. 6 wherein, with the plug fitted in the receptacle, the height of the receptacle along the engagement axis C from the bottom surface of the receptacle to the top surface of the plug can be reduced to as small as about 1 mm.

Therefore, the coaxial connector of the invention produces great advantageous effects when used in cell phones and other like electronic devices of which a thinner design is required. Further, being coaxial, the connector of the invention may be most suitably used for transmission of image signals of high quality images, transmission of broadband signals for cell phones or the like.

What is claimed is:

1. A coaxial connector comprising:

A receptacle having an engagement hole formed inside; and a plug engaging with the receptacle along an engagement axis, wherein the receptacle includes an annular receptacle external contact of which an inner peripheral surface is exposed inside the engagement hole, and a receptacle central contact having a receptacle central contact portion exposed in a direction perpendicular to the engagement axis inside the engagement hole, wherein the plug includes a plug external contact engaging with the inside of the engagement hole of the receptacle so as to be in contact with the inner peripheral surface of the annular receptacle external contact when the plug engages with the receptacle, and a cantilever-shaped plug central contact having an extension extending in the direction perpendicular to the engagement axis with given spring characteristics secured by a length of the extension and a plug central contact portion positioned so as to be in contact with the receptacle central contact portion exposed in the direction perpendicular to the engagement axis inside the engagement hole when the plug engages with the receptacle, and wherein a contact plane between the plug central contact portion and the receptacle central contact portion lies substantially in a same plane as the extension of the plug central contact.

2. The coaxial connector according to claim 1, wherein the receptacle comprises a receptacle insulator covering an outer periphery of the receptacle external contact and holding the receptacle central contact.

3. The coaxial connector according to claim 2, wherein the receptacle external contact, the receptacle insulator, and the receptacle central contact integrally formed by molding.

4. The coaxial connector according to claim 1, wherein the inner peripheral surface of the receptacle external contact is formed with an annular receptacle external contact portion to come into contact with the plug external contact and engage with the plug external contact.

5. The coaxial connector according to claim 4, wherein the receptacle external contact portion is formed by a press.

6. The coaxial connector according to claim 1, wherein the plug external contact is provided around the engagement axis and shaped into an arc having a missing segment in a direction in which the extension of the plug central contact extends.

7. The coaxial connector according to claim 1, further comprising a receptacle member including a plurality of the receptacles that engage with a plurality of the plugs, respectively.

* * * * *